United States Patent [19]

Jarvis

[11] 4,102,087

[45] Jul. 25, 1978

[54] STAND CONSTRUCTION SYSTEM

[75] Inventor: Barry Michael Frank Jarvis, Snitterfield, England

[73] Assignee: Exhibition Showplace Services Limited, United Kingdom

[21] Appl. No.: 776,723

[22] Filed: Mar. 11, 1977

[51] Int. Cl.[2] ..... E04H 3/12

[52] U.S. Cl. ..... 52/9; 52/8; 52/36

[58] Field of Search ..... 52/8, 6, 9, 182, 36, 52/184, 188, 191; 182/178; 297/331, 335, 336

[56] References Cited

U.S. PATENT DOCUMENTS

| | | | |
|---|---|---|---|
| 1,458,866 | 6/1923 | Wetzel | 52/182 X |
| 1,993,530 | 3/1935 | Schaffer | 297/335 |
| 2,287,561 | 6/1942 | Page et al. | 52/8 X |
| 2,295,311 | 9/1942 | Uecker et al. | 52/8 |
| 2,611,422 | 9/1952 | Roney | 52/9 X |
| 3,025,106 | 3/1962 | Evans et al. | 52/9 X |
| 3,194,601 | 7/1965 | Hoven et al. | 297/336 X |
| 3,352,069 | 11/1967 | Curra, Jr. | 52/9 |
| 4,000,586 | 1/1977 | Vance et al. | 52/9 |

FOREIGN PATENT DOCUMENTS

| | | | |
|---|---|---|---|
| 548,198 | 10/1957 | Canada | 182/178 |
| 1,083,500 | 1/1955 | France | 52/6 |
| 908,249 | 4/1946 | France | 297/336 |
| 1,069,369 | 11/1959 | Fed. Rep. of Germany | 182/178 |
| 542,564 | 4/1956 | Italy | 52/6 |
| 1,420,615 | 1/1976 | United Kingdom | 52/9 |

*Primary Examiner*—Leslie Braun

*Attorney, Agent, or Firm*—Weingarten, Maxham & Schurgin

[57] ABSTRACT

A stand construction system which includes a support frame, support means on said support frame to be spaced from a surface on which the system rests, a floor-carrying member, and connecting means adjacent a rear end of said floor-carrying member locatable on said support means to position said rear end substantially horizontally, the floor-carrying member having its front end arranged to be supported directly by the surface or by support means of a further support frame to be arranged at a lower level than the support means of the first said support frame.

10 Claims, 10 Drawing Figures

STAND CONSTRUCTION SYSTEM

The invention relates to an improved stand construction system and is particularly concerned with a system constructed or to be constructed from a plurality preformed components.

Various systems are known for constructing stands which utilise frame-like units. A common disadvantage os such systems is that they require a large number of separate components and assembly is somewhat difficult. Furthermore, where seats are to be included, the seats are often of a plank-type which not only add to the number of separate components required, but are uncomfortable to sit on for long periods. Some systems utilise multiple-seat units which provide more comfortable seating. However the units are bulky to stow, and difficult to handle and erect. An object of the invention is to provide a stand construction system which mitigates the foregoing disadvantages.

According to the invention, a stand construction system includes a support frame which has support means to be spaced from a surface on which the system rests,/and a floor-carrying member having connecting means adjacent a rear end thereof arranged to locate on the support means to position said rear end substantially horizontally, the front end of the member being arranged to be supported directly by the surface or by support means of a further support frame to be arranged at a lower level than the support means of the first said support frame.

Where a further support frame is provided, the two support frames are preferably arranged to be interconnected by side frames which will extend between ends of one support frame and adjacent ends of the other support frame. In such a case, the ends of the lower support frame are preferably arranged to be connected directly to respective ends of the side frames, and the ends of the first said support frame are preferably arranged to be connected to the respective opposite ends of the side frames by means of spacer members, or by ends of further side frames extending towards adjacent ends of an additional support frame for supporting another floor-carrying member.

Preferably, three or more floor-carrying members are to be arranged one behind the other. In such a case, the rear end of each floor-carrying member may be arranged to locate the adjacent front end of the next rear floor-carrying member to inhibit removal of the or each floor-carrying member positioned intermediate the front and rearmost floor-carrying members.

Side safety rails may be positioned along sides of the floor-carrying members and a rear safety rail may be positioned along the rear of the rearmost floor-carrying member, the side rails being arranged to be supported by means of rail supports locatable on said side frames or said spacer members. The rear safety rail may comprise two support frames which may themselves be supported one above the other by means of legs which locate on said side frames or said spacer members. The legs may be arranged to interconnect the rear ends of the side safety rails and the adjacent ends of the rear safety rail.

Preferably, the or each floor-carrying member is arranged to carry one or more seats. The or each seat may be collapsible and movable between a stowed position beneath a floor on said floor-carrying member and an erected position above said floor. The or each seat may include a runner captive in a slide on said floor-carrying member, the runner being arranged to move from one end of the slide into a well at the other end of the slide when the seat is moved from the stowed position to the erected position. The runner is preferably retained at said one end of runner by clip means when the seat occupies the stowed position. Preferably, the seat frames includes a retaining member which co-operates with means on said floor-carrying member when the seat is erected and which, together with the runner positioned in the well, is arranged to retain the seat in its erected position. The seat may include a backrest which defines a recess for receiving a complementary shaped extension of a seat portion when the seat is in its erected position so that the backrest forms substantially a continuation of said extension. Where rear safety rails are provided, a plurality of seats may be mounted on a support which is arranged to be carried by the rear safety rail.

The invention also includes a stand made with a stand construction system according to any of the five immediately preceding paragraphs.

The invention will now be described, by way of example only, with reference to the accompanying drawings in which.

Figure 1:
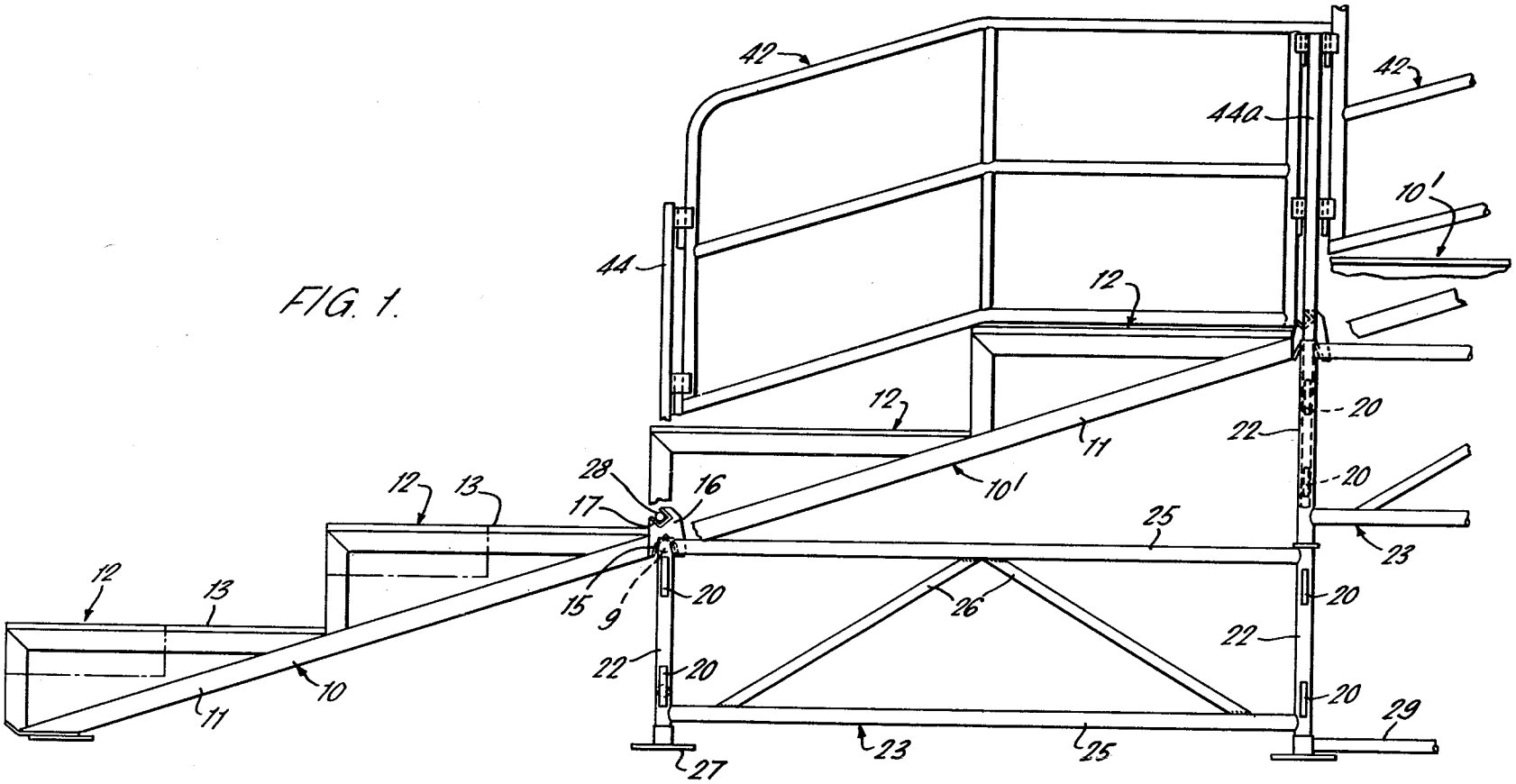
FIG. 1 is a side elevation of an assembly including floor-carrying members, support frames and side frames.
Figure 3:
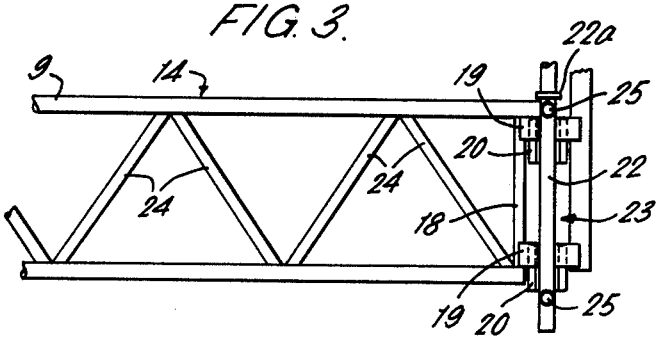
FIG. 3 is a view looking in the direction of Arrow A in FIG. 2 and illustrates one of the support frames in detail.
Figure 4:
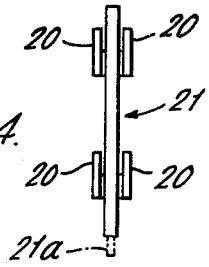
FIG. 4 illustrates a spacer leg.

A floor-carrying member 10 comprises two parallel beams 11 each of which is welded to floor supports 12 as viewed in FIG. 1. Floor boards 13 extend between the upper surfaces of the supports 12 and will occupy horizontal planes when the floor-carrying member is assembled in the seating system. The front end of the floor-carrying member 10 is arranged to rest on the ground and its rear end is supported horizontally by a tubular cross-member 9 of a support frame 14. The tube 9 locates in a channel 15 welded into recesses formed in upstanding plates 16 positioned at the rear ends of the beams 11. The plates 16 are also formed with further recesses in which is welded a further channel 17 for locating another floor-carrying member 10 as will be hereinafter described. Each end of the support frame 14 is provided with an end member 18 (see FIG. 3) which carries two sockets 19. The sockets 19 locate two pegs 20 which are mounted on a leg 22 at one end of a rearwardly extending side frame 23. The side frame has two legs 22 interconnected by members 25, and each leg carries additional pegs 20 to enable two support frames 14 to be interconnected end-to-end by the side frame 23. The support frame 14 is braced by struts 24, and the side frames 23 are braced by struts 26. As shown in FIG. 1, each side frame 23 is supported on the ground by 2 feet 27 in which the legs 22 locate. The rear legs 22 of the side frames 23 spigotally locate the lower ends of front legs 22 of further side frames 23 which also extend rearwardly. The legs 22 of the further side frames support a further support frame 14 to enable another floor-carrying member 10 to be placed in position behind the front floor-carrying member 10. As shown in FIG. 1, the front end of the other floor-carrying member 10 is provided with a transverse tube 28 which locates in the channel 17 of plate 16. After locating the tube 28, the other floor-carrying member 10 is allowed to pivot downwardly about the axis of the tube and will come to rest with its channel 15 located on the tube 9 of the further support frame. The channel 17 faces generally forwardly and prevents the further floor-carrying member 10 from being removed by lifting it vertically. As will be appreciated, the rear end of the further side frame 23 will require support from the ground, and this can be provided either by another side frame positioned on the ground, or by a spacer leg 21 shown in FIG. 4 having its lower end supported by a foot 27. The spacer legs 21 are of similar construction to the legs 22 of the side frames 23 and are capable of locating the ends of support frames 14 on pegs 20 on the legs. The dimensions of the floor-carrying members 10 and support frames 14 are chosen so that a convenient number of floor-carrying members 10 (for example six) can rest side-by-side on one support frame 14. The feet 27 may be interconnected by a bracing tube 29 for additional stability and ease of assembly.

Figure 2:
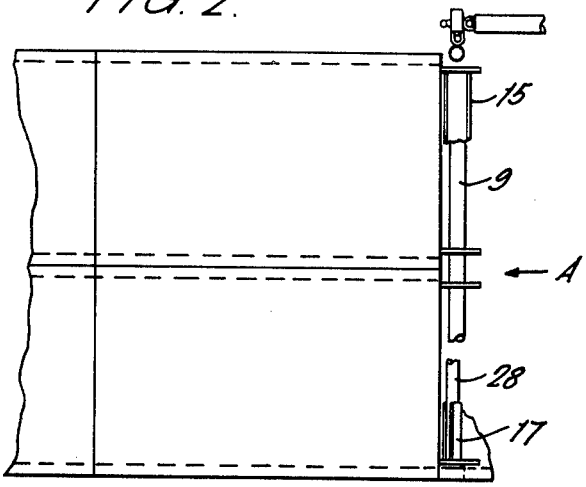
FIG. 2 is a plan view of part of the floor-carrying member shown in FIG. 1.
Figure 5:
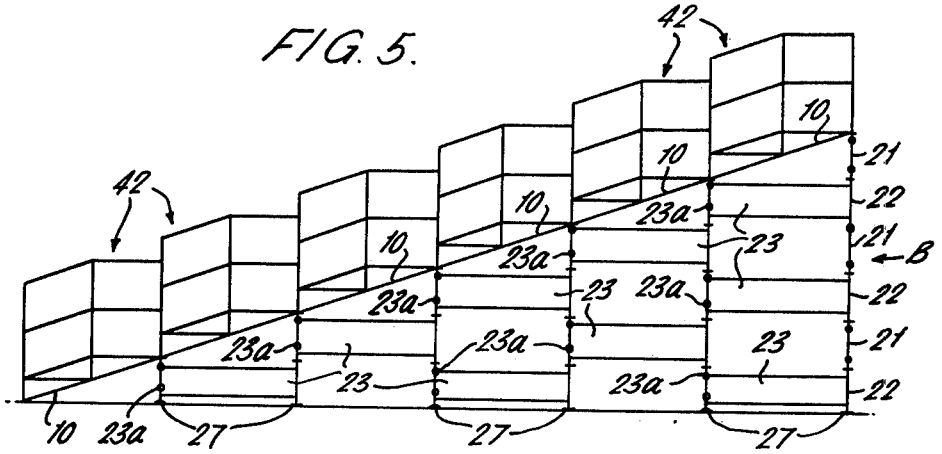
FIG. 5 is a diagrammatic side elevation illustrating the manner in which the system can be used to construct a stand.
Figure 6:
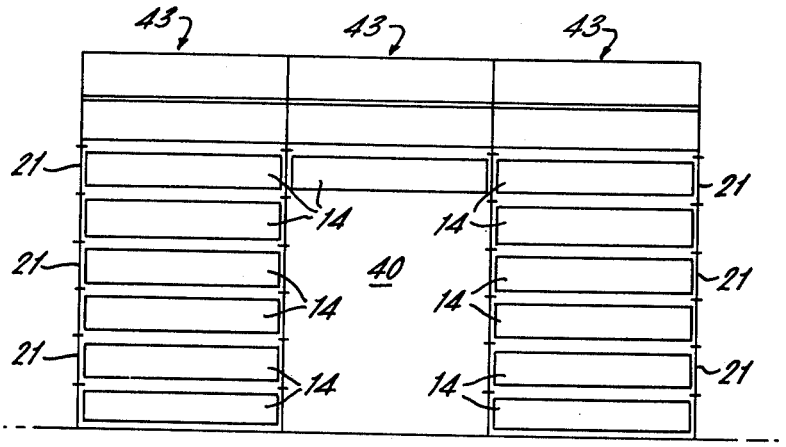
FIG. 6 is a view looking in the direction of Arrow B in FIG. 5.

FIGS. 5 and 6 illustrate diagrammatically a typical grandstand which can be constructed using a system in accordance with the invention. The support frames 14 and side frames 23 are erected as described with reference to FIGS. 1, 2 and 3 until the required number of tiers have been erected. Starting from the front, floor-carrying members 10 are then placed in position on the erected framework. The lower rearmost side frames 23 shown in FIG. 5 rest on feet 27. Spacer legs 21 having spigots 21*a* thereon (as shown in broken lines in FIG. 4) interconnect the rear leg 22 of the lower side frames with the rear legs of the side frames 23 arranged above them. Spacer legs 21 also interconnect rear legs 22 of the upper rearmost side frames 23 and the adjacent side frames below, and further spacer legs 21 are used to carry a support frame 14 for supporting the rear end of each rearmost floor-carrying member 10. Further support frames 14 extend between the other spacer legs 21 and horizontally between the side members 23 where indicated by circles 23*a*. As shown in FIG. 6, two bays of erected components may be interconnected by one or more additional support frames 14 to define an opening 40. Such additional support frames 14 may also support floor-carrying members 10. Side and rear safety rails indicated generally at 42 and 43 respectively may be added after erection of the system has been completed. Further bays may be added if required.

Each side rail 42 (see FIG. 1) is supported at its forward end by a rail support 44 which locates on the pegs 20 of the side frame leg 22 immediately below. The rear end of each side rail 42 is similarly supported either by a rail support 44 or by a modified rail support 44*a* by which the rear end of the side rail can be connected to the forward end of an adjacent side rail.

Each rear rail 43 (see FIG. 7) comprises two support frames 14 supported by means of extended legs 45. Each leg 45 has four sets of pegs 20 spaced to support the two frames 14 as shown. The legs 45 spigotally locate in the upper ends of the spacer legs 21 and may support two adjacent rear rails 43. The two legs 45 at the outer ends of the rear rails 43 may support the rear ends of the rearmost side rails 42.

Figure 8:
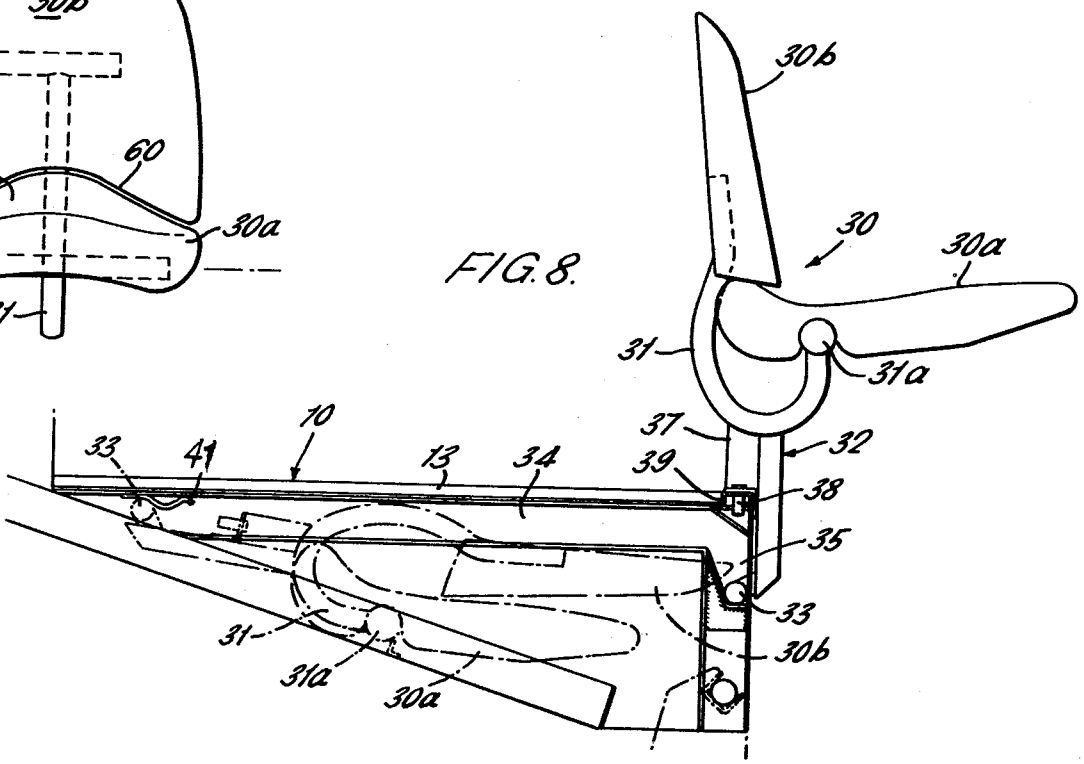
FIG 8 illustrates the manner in which a seat can be mounted on a floor-carrying member.

Referring now to FIG. 8, each floor-carrying member 10 can be adapted to house one or more collapsible seats indicated generally at 30. Each seat includes a seat portion 30*a* and a backrest 30*b* interconnected by a tubular frame 31. The seat portion 30*a* is pivoted to the frame 31 at 31*a*. The frame 31 is welded to a leg 32 the free end of which is welded to a runner 33. The runner 33 locates in a slide 34 on the floor-carrying member 10 which is formed with a well 35 at its forward end. The leg 32 includes a flange 37 which is welded to a pin 38. A spring retaining clip 41 is arranged at the rear end of the slide 34 and snaps over the runner 33 when the seat is stowed in its collapsed condition as shown in broken lines. To erect the seat, the seat is urged forward to release the runner from the spring clip and is withdrawn from beneath the floor boards 13 so that the runner 33 slides into the well 35. The seat is then pivoted upwardly about the captive runner until the pin 38 aligns with a hole formed in a metal cross-member 39 along the front of the floor-carrying member 10. The seat is then lowered so that the pin 38 enters the hole as shown in FIG. 8 and retains the seat in its erected position. It is envisaged that two rows of six seats may be carried by six floor-carrying members 10, arranged side-by-side on the support members 14.

Figure 7:
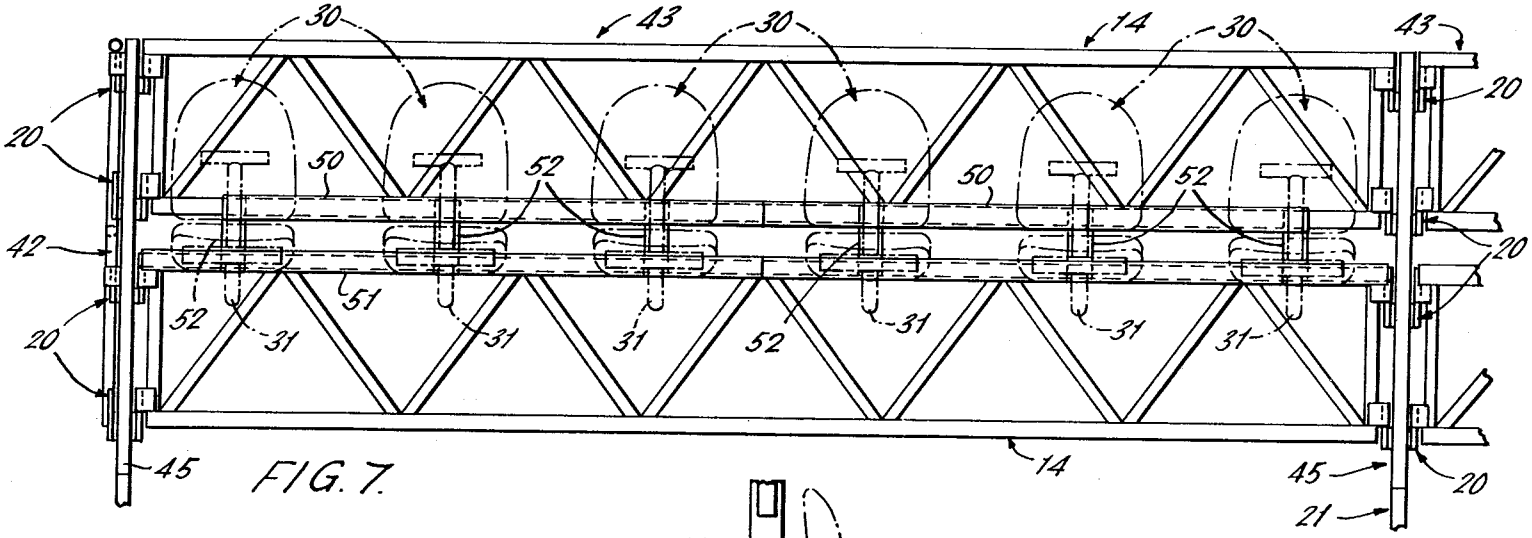
FIG. 7 is a view of a preferred form of rear safety rail.
Figure 9:
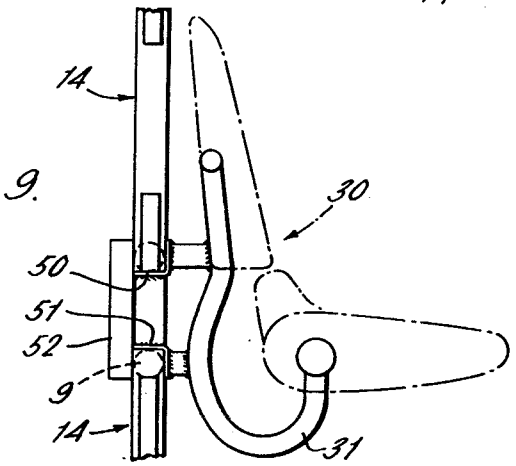
FIG. 9 shows a rear safety rail seat mounting.

As shown in FIGS. 7 and 9 each rear rail 43 may be arranged to support a row of six seats. Each of the seats 30 has its frame 31 welded to upper and lower supports 50, 51 respectively which are interconnected at intervals by vertical spacers 52. The upper and lower seat supports fit between the two support frames 14 and maintain the seat frames 31 in the position shown in FIG. 9. During assembly of each rear rail 43, the lower support frame 14 is first located on the lower pegs 20 of the associated legs 45. The lower seat support 51 is then placed in position on the tubular cross-member 9 of the lower support frame 14 and the upper support frame 14 placed in position so as to sandwich the seat supports 50, 51 between the two support frames. Preferably each set of seat supports 50, 51 carries three seat frames 31, and two sets of supports 50, 51 are sandwiched between the upper and lower support frames 14.

Figure 10:
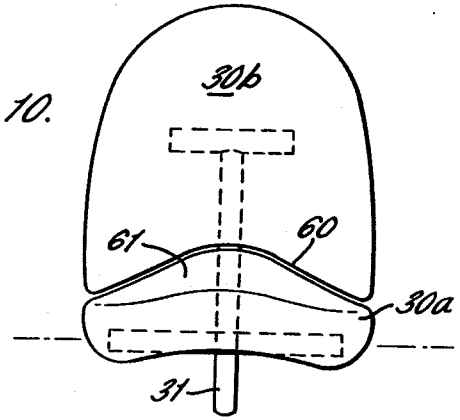
FIG. 10 is a front view of a preferred form of seat.

The seats may be of any convenient kind but we prefer to use a seat and backrest arrangement as shown clearly in FIG. 10. In FIG. 10, the backrest 30*b* is formed along its lower edge with an inverted V-shaped recess 60 which receives a complementary-shaped extension 61 of the seat portion 30*a*, Thus, when the seat is in the erected position, the backrest 30*b* forms substantially a continuation of the extension 61. This arrangement is particularly advantageous as the extension 61 provides ideal support for the lower part of the back of a person occupying the seat, and the transition between the seat portion 30*a* and the backrest 30*b* is almost imperceptible. The seat portions may be hollow and be formed from glass fibre reinforced plastics.

If desired the floor-carrying members 10 can support a number of steps as indicated in chain-dotted lines in FIG. 1. Such step members can be located between selected floor-carrying members to enable spectators to climb to the appropriate row of seats on the grandstand. The steps may terminate at an aisle unit or landing provided by floor boarding supported directly by the beams 11 with the floor supports 12 omitted. If the grandstand is to increase in height incrementally rather than in the progressive manner illustrated in FIG. 5, non-sloping aisles should be provided between the rear end of one floor-carrying member 10 and the forward end of the next rearmost member 10. Members 10 which carry steps may also be utilised to construct staircases inside the grandstand structure. The units utilised to form aisles may also be used to form walkway ramps either internally or externally of the grandstand. A tower may be erected at the rear of the grandstand for use, for example, by television camera operators. Such a tower may conveniently by erected by utilising further side frames 23, extending rearwardly from the grandstand, and associated support frames 14. Aisle units may be used to form a floor at B top of such a tower.

Adjustable spacer legs may be provided to enable the system to be erected on uneven ground.

Side frames 23 to be erected upon those which are supported by the feet 27 may be provided with rings 22*a* (see FIG. 3) adjacent the lower ends of their legs 22. The rings 22*a* prevent the removal of support frames from lower side frames in the erected structure.

The seating system described does not require the use of tools to aid erection, and is easier and quicker to erect than known systems due to the relatively small number of components required. Furthermore, the seats are more comfortable than the plank-type seating of certain known systems, and, unlike known multiple seating units, are not bulky to stow.

Although a chequered arrangement of support and side frames is shown in FIGS. 5 and 6, the frames could be arranged differently if desired.

Various components, such as the seat frame, may be die cast thus avoiding the need to weld numerous components together.

What I claim as my invention and desire to secure by Letters Patent of the United States is:

1. A modular stand construction system comprising a support frame, support means on said support frame to be spaced from a surface on which the system rests, a floor-carrying member, a floor means mounted on said floor-carrying member, connecting means adjacent a rear end of said floor-carrying member locatable on said support means to position said rear end substantially horizontally, said floor-carrying member having its front end arranged to be supported directly by the surface or by support means of a further support frame to be arranged at a lower level than the support means of the first said support frame, and a collapsible seat coupled to said floor means, said collapsible seat being engaged with said floor means when in an erect position and being movable from the erect position to a stowed position beneath said floor means by disengaging and pivoting said seat forward to a substantially horizontal position and then sliding it beneath said floor means.

2. A stand construction system according to claim 1 and in the case where a further support frame is provided, the two support frames are arranged to be interconnected by side frames which extend between ends of one support frame and adjacent ends of the other support frame, the ends of the lower support frame are arranged to be connected directly to the respective ends of the side frames, and spacer members are provided which connect the ends of the first said support frame to the respective opposite ends of the side frame.

3. A stand construction system according to claim 2 in which at least three floor-carrying members are to be arranged one behind the other, the rear end of each floor-carrying member being provided with channel means which pivotally locate the adjacent front end of the next rear floor-carrying member to inhibit removal of the or each floor-carrying member positioned intermediate the front and rearmost floor-carrying members.

4. A stand construction system, according to claim 3, in which the channel faces generally forwardly and locates the adjacent front end of the next rear floor-carrying member so that the said adjacent front end cannot be removed from the channel by moving it vertically.

5. A stand construction system according to claim 3 in which side safety rails are arranged to be positioned along sides of the floor-carrying members, and a rear safety rail is arranged to be positioned along the rear of the rearmost floor-carrying member, rail supports being provided for said side rails, said rail supports being locatable on said side frames or said spacer members, the rear safety rail comprising two of said support frames, supporting legs being provided for supporting the frames one above the other, said legs being locatable on said side frames or said spacer members.

6. A stand construction system, according to claim 5, in which the legs are arranged to interconnect the rear ends of the side safety rails and the adjacent ends of the rear safety rails.

7. A stand construction system according to claim 5 in which a plurality of seats is mounted on a support which is arranged to be carried by the rear safety rail between the two support frames arranged one above the other.

8. A stand construction system according to claim 1 in which the or each seat includes a frame, a runner being mounted on said frame, and a slide being provided on said floor-carrying member, in which slide the runner is captive, the runner being arranged to move from one end of the slide into a well at the other end of the slide when the seat is moved from the stowed position to the erected position, the seat frame including a retaining member which co-operates with means on said floor-carrying member when the seat is erected and which, together with the runner positioned in the well, is arranged to retain the seat in its erected position.

9. A stand construction system, according to claim 1, in which the or each seat includes a backrest which defines a recess for receiving a complementary shaped extension of a seat portion when the seat is in its erected position so that the backrest forms substantially a continuation of said extension.

10. A stand construction system comprising a support frame, support means on said support frame to be spaced from a surface on which the system rests, a floor-carrying member, a floor mounted on said floor-carrying member, connecting means adjacent a rear end of said floor-carrying member locatable on said support means to position said rear end substantially horizontally, said floor-carrying member having its front end arranged to be supported directly by the surface or by support means of a further support frame to be arranged at a lower level than the support means of the first said frame, a slide on said floor-carrying member, a runner captive in said slide, a seat frame connected to said runner, a seat on said frame which is collapsible and movable between a stowed position beneath said floor and an erected position above said floor, said runner being arranged to move from one end of said slide into a well at the other end of said slide when said seat is moved from the stowed position to the erected position, and clip means provided at said one end of said slide to retain said runner at said one end of said slide when said seat occupies the stowed position.

* * * * *